US007465181B1

(12) United States Patent
Bridges et al.

(10) Patent No.: US 7,465,181 B1
(45) Date of Patent: Dec. 16, 2008

(54) LOCKING HEADER FOR UNIVERSAL SERIAL BUS DEVICE RETENTION

(75) Inventors: Jeremy Scott Bridges, Apex, NC (US); Norman Bruce Desrosiers, Oxford, NC (US); Dean Frederick Herring, Youngsville, NC (US); Paul Andrew Wormsbecher, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/847,704

(22) Filed: Aug. 30, 2007

(51) Int. Cl.
*H01R 13/627* (2006.01)

(52) U.S. Cl. ..... 439/358; 439/133

(58) Field of Classification Search ..... 439/352, 439/133, 304, 358, 147, 923
See application file for complete search history.

(56) References Cited

U.S. PATENT DOCUMENTS

| | | | | |
|---|---|---|---|---|
| 6,619,976 | B2 * | 9/2003 | Huetter et al. | 439/352 |
| 6,902,432 | B2 * | 6/2005 | Morikawa et al. | 439/607 |
| 6,991,479 | B2 | 1/2006 | Miao | |
| 7,094,099 | B2 | 8/2006 | Daggett et al. | |
| 7,128,595 | B2 | 10/2006 | Boutros | |
| 7,160,137 | B1 | 1/2007 | Yeh | |
| 2003/0224637 | A1 | 12/2003 | Ling | |
| 2005/0202698 | A1 * | 9/2005 | Miao | 439/133 |
| 2006/0134962 | A1 | 6/2006 | Yeh | |
| 2007/0016965 | A1 | 1/2007 | Dan et al. | |
| 2007/0037454 | A1 | 2/2007 | Bushby | |
| 2007/0099504 | A1 | 5/2007 | Wu | |

FOREIGN PATENT DOCUMENTS

| | | | |
|---|---|---|---|
| JP | 2006133920 | A | 5/2006 |

* cited by examiner

*Primary Examiner*—Hae Moon Hyeon
(74) *Attorney, Agent, or Firm*—Cynthia Byrd; Jeffrey L. Streets

(57) ABSTRACT

A device for locking a USB device to a USB header includes a member secured to a USB header and selectively movable between a locked position that blocks outward movement of a spring finger of the USB header and an unlocked position that permits outward movement of the spring finger. The selectively moveable member may include a collar secured around the USB header. In one embodiment, the collar slides in an axial direction relative to the axis of the USB header. In another embodiment, the collar slides in a transverse direction relative to the axis of the USB header. In yet another embodiment, the selectively moveable member is a lever, button or dial coupled to a collar positioned around the USB header. For example, the member may be a lever pivotally coupled to the collar.

7 Claims, 4 Drawing Sheets

LOCKING HEADER FOR UNIVERSAL SERIAL BUS DEVICE RETENTION

BACKGROUND

1. Field of the Invention

The present invention relates to devices for locking a universal serial bus connector.

2. Background of the Related Art

Universal Serial Bus (USB) is a serial bus standard to interface devices. USB was designed to allow peripherals to be connected using a single standardized interface socket, to improve plug-and-play capabilities by allowing devices to be connected and disconnected without rebooting the computer. Other convenient features include powering low-consumption devices without the need for an external power supply and allowing some devices to be used without requiring individual device drivers to be installed. USB can connect computer peripherals such as mouse devices, keyboards, PDAs, gamepads and joysticks, scanners, digital cameras and printers. For many of these devices USB has become the standard connection method.

USB connectors are designed so that they cannot be plugged-in upside down, and it is readily apparent when the plug and socket are correctly mated. USB cables and small USB devices are held in place by the gripping force that the header applies to the plug. However, the force needed to make or break a connection is modest, so that connections can be made in awkward circumstances or by those with motor disabilities A universal serial bus (USB) device has a rectangular connector made with windows on the longer sides that produce a slight frictional feel when mated to a USB header or port. As the USB connector slides into a USB header, small spring fingers on the header are flexed out of the way. When the USB device is fully connected, the spring fingers return to their starting position, but with a portion of the spring fingers extending into the USB device windows. Accordingly, the USB connector is secured under a modest resistance.

However, there are applications in which it may be desirable to avoid unintended disconnection of the USB device connector. For example, it would be desirable for the connectors of USB peripherals, like printers, to be strongly secured against unintended disconnection since they are typically installed for long periods of time. Similarly, it may be desirably for a user to temporarily elect to tightly secure a game controller or joystick to avoid accident disconnection during an active game. Still further, a USB device such as a flash drive may be installed at the factory and should not become disconnected during shipping.

Therefore, there is a need for an improved device for retaining or locking a USB connector to a USB header. It would be desirable if such a locking device was simple in design and operation. It would also be desirable if such a locking device could be implemented on USB headers without any modification to existing USB devices. It would be still further desirable if such a locking device could be installed as an add-on device to existing USB headers.

SUMMARY OF THE INVENTION

One embodiment of the present invention provides a device for locking a USB device to a USB header. The device comprises a member secured to a USB header and selectively movable between a locked position that blocks outward movement of a spring finger of the USB header and an unlocked position that permits outward movement of the spring finger. Preferably, placing the member in the locked position causes the member to block outward movement of the spring finger directly behind a retention tab of the spring finger. Optionally, the device may include a spring that biases the member into the locked position.

Optionally, the selectively moveable member may include a collar secured around the USB header. In one embodiment, the collar slides in an axial direction relative to the axis of the USB header. In another embodiment, the collar slides in a transverse direction relative to the axis of the USB header. A preferred collar for transverse sliding has an inner surface with a land and a groove facing the spring finger, wherein the collar is slideable between the locked position with the land blocking movement of the spring finger and the unlocked position with the groove allowing movement of the spring finger. In yet another embodiment, the selectively moveable member is a lever, button or dial coupled to a collar positioned around the USB header. For example, the member may be a lever pivotally coupled to the collar.

A further embodiment of the invention provides a lockable USB header comprising a USB header with spring fingers adapted to spring outward as a USB device connector is being inserted or withdrawn and to spring inward into windows formed in the USB device connector when the USB device is fully inserted or fully withdrawn. The lockable US header also includes a member secured to the USB header and selectively movable between a locked position that blocks outward movement of the spring fingers and an unlocked position that permits outward movement of the spring fingers.

DETAILED DESCRIPTION

Figure 1A:
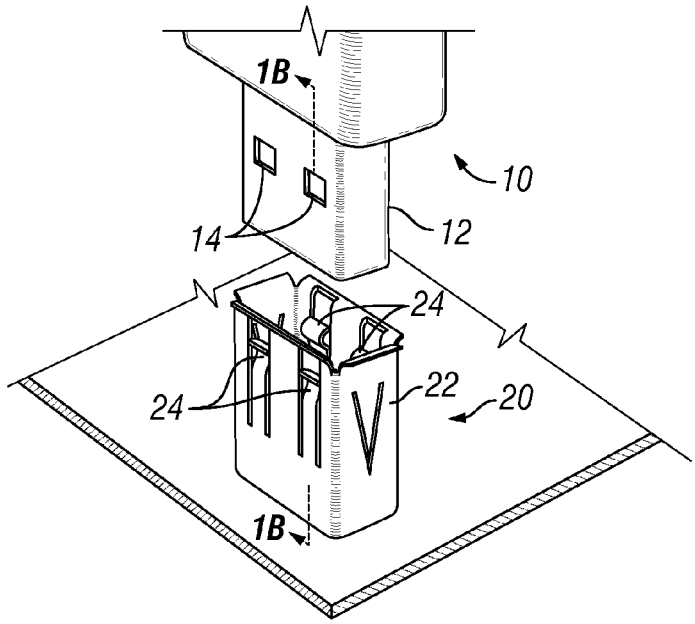
FIG. 1A (Prior Art)
FIG. 1A is a perspective view of a USB device connector axially aligned with a USB header.

The present invention provides various embodiments of a device that selectively blocks the outward flexing of a spring finger of a standard USB header in order to prevent disconnection of a USB device connected thereto. One embodiment of the present invention provides a device for locking a USB device to a USB header. The device comprises a member that is securable or secured to a USB header and selectively movable between a locked position that blocks outward movement of the spring finger of the USB header and an unlocked position that permits outward movement of the spring finger. Preferably, placing the member in the locked position causes the member to block outward movement of the spring finger directly behind a retention tab of the spring finger. It is also preferable that the member be designed to simultaneously block outward movement of a plurality of spring fingers, such as blocking each of the four spring fingers in a standard USB header.

Optionally, the selectively moveable member may include a collar secured around the USB header. In one embodiment, the collar slides in an axial direction relative to the axis of the USB header. Accordingly, the collar may have a generally rectangular profile that slides directly over the generally rectangular outer surface of the USB header. In another embodiment, the collar slides in a transverse direction relative to the axis of the USB header, preferably in a direction generally parallel to the long side of the rectangular USB header having a spring finger. A preferred collar for transverse sliding has an inner surface with a land and a groove facing the side of the USB header having the spring finger. This collar is transversely slideable between the locked position with the land blocking movement of the spring finger and the unlocked position with the groove allowing movement of the spring finger.

In yet another embodiment, the selectively moveable member is a lever, button or dial coupled to a collar secured around the USB header. For example, the member may be a lever pivotally coupled to the collar. Optionally, the lever may be selectively retained in the locked position by receiving the distal end of the lever within a depression in the outer surface of the spring finger. Where the USB header has multiple spring fingers, there may be multiple levers. Multiple levers on the same side of the USB header are preferably coupled for coordinated operation. The levers desirably extend away from the USB header for ease of finger tip access and actuation. A particularly preferred embodiment includes a pair of coupled levers on one side of the USB header for engaging a first pair of spring fingers and overcoming a biasing member to selectively move the collar into engagement with a second pair of spring fingers on the opposing side of the USB header.

Some embodiments of the device of the present invention may utilize springs (other than the spring fingers in the USB header) to bias moveable members toward either the locked position or the unlocked position. It may be desirable in some applications for the spring to bias the device toward a locked position so that the device will lock the USB connection unless a user acts upon the device to release the connection. In other applications it may be desirable for the spring to bias the device toward an unlocked position so that the device does not lock unless the user acts upon the device. Still, it should be recognized that many of the advantages of the present invention may be realized without the use of springs, although the movement of the blocking members between locked and unlocked positions is entirely manual. Depending upon the physical orientation of the members, it may be necessary to use other forces, such as frictional forces, to retain the members in a given position.

In another embodiment, the device may be an add-on device that can be selectively secured adjacent a USB header below a flared end of the USB header. An add-on device allows the features of the invention to be implemented in existing computer systems with USB headers. A first non-limiting example is a collar that may be flexed opened at one end in order to reach around the header, where the collar is adapted so that the opened end can be easily coupled in place. A second non-limiting example is a collar comprising two halves that are easily fastened together, such as with a snap-together connection, around the USB header.

A further embodiment of the invention provides a lockable USB header comprising a USB header with spring fingers adapted to spring outward as a USB device connector is being inserted or withdrawn and to spring inward into windows formed in the USB device connector when the USB device is fully inserted or fully withdrawn. The lockable US header also includes a member secured to the USB header and selectively movable between a locked position that blocks outward movement of the spring fingers and an unlocked position that permits outward movement of the spring fingers. The member may take the form of any of the embodiments described above, or by reference to any of the figures below.

FIG. 1A is a perspective view of a USB device connector 10 axially aligned with a USB header 20. The device connector 10 has a rectangular metal body 12 with a pair of windows 14 through each of the long sides of the rectangular metal body 12 (the pair of windows on the back side are not shown). The rectangular metal body 12 has well-known standard dimensions in order to be easily and closely received within the rectangular metal body 22 of the USB header 20. In order to couple the USB device connector 10 to the USB header 20, the connector 10 is aligned as shown and moved translationally (i.e., without rotation) in the axial direction. The USB header 20 includes four spring fingers 24 that are positioned about the perimeter of the rectangular header body 22 in order to align with the four windows 14 of the rectangular connector body 12. During the coupling of the device connector 10 with the header 20, each of the windows 14 will be engaged by a spring finger 24. The manner in which this coupling is achieved is described further in references to FIGS. 1B through 1D.

Figure 1B:
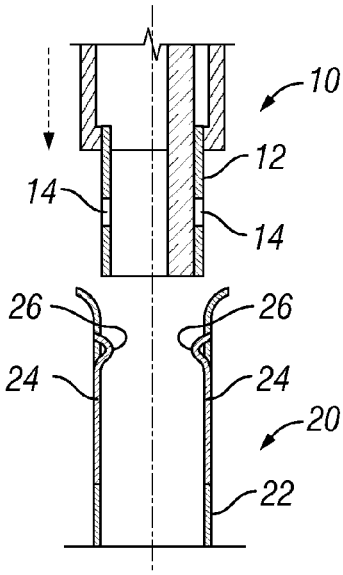
FIG. 1B (Prior Art)
FIG. 1B is a partial cross-sectional side view of the USB device connector of FIG. 1A.

FIG. 1B is a partial cross-sectional side view of the USB device connector 10 of FIG. 1A as seen along line A-A. This side view shows a window 14 in each of the long sides of the rectangular metal body 12. The connector 10 is axially aligned with the header 20 and the components are ready to be coupled. The header 20 shows that the spring fingers 24 each have a distal end with an inwardly protruding tab 26 for engagement with the individual windows 14.

Figure 1C:
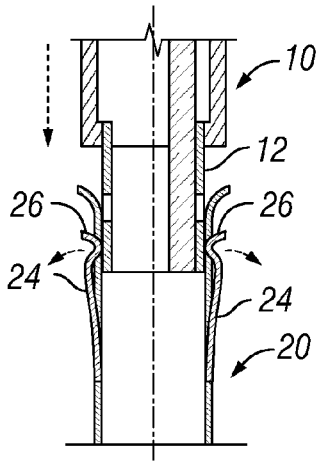
FIG. 1C (Prior Art)
FIG. 1C is a partial cross-sectional side view of the USB device connector of FIG. 1B with the connector partially inserted in the USB header.

FIG. 1C is a partial cross-sectional side view of the USB device connector 10 of FIG. 1B with the connector partially inserted in the USB header 20. At this stage of insertion, the connector body 12 has slid between the tabs 26 causing the opposing spring fingers 24 to flex and displace outwardly. The rounded shape of the tabs 26 allows the tabs to deflect outwardly when engaged by the body 12 either from the top as shown, or from the bottom (as occurs during removal of the connector body 12).

Figure 1D:
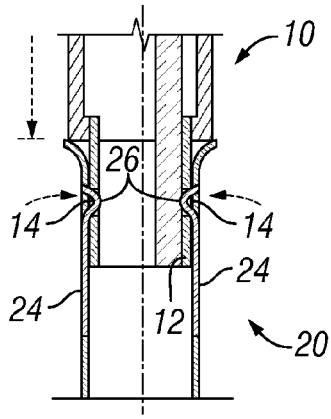
FIG. 1D (Prior Art)
FIG. 1D is a partial cross-sectional side view of the USB device connector of FIG. 1A with the connector fully inserted in the USB header.

FIG. 1D is a partial cross-sectional side view of the USB device connector of FIG. 1C with the connector body 12 fully inserted and coupled in the USB header 20. With the windows 14 now axially aligned with the tabs 26 of the spring fingers 24, the force of the spring fingers 24 causes the tabs 26 to be inserted within the windows 14. Accordingly, the spring finger tabs 26 exert only a moderate resistance against removal of the connector body 12. Essentially the same amount of force that is required to insert the connector 10 is sufficient to remove the connector 10.

Figure 2A:
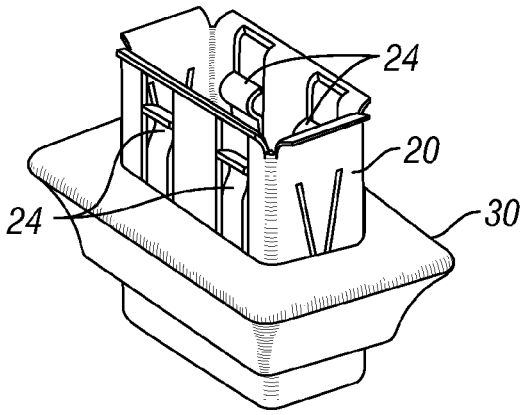
FIG. 2A is a perspective view of a USB header and an axially slidably collar in the unlocked position.

FIG. 2A is a perspective view of a USB header 20 and an axially slidably collar 30 in the unlocked position. In this unlocked position, the collar 30 is low enough relative to the spring fingers 24 that it does not significantly alter the operation of the USB header 20 from that described in reference to FIGS. 1A through 1D. In particular, the unlocked position of the collar 30 does not significantly oppose the outward flexing of the spring fingers 24, since it is not necessary for the lowest portion of the spring fingers 24 to flex outwardly. Any resistance that the collar 30 may pose against the spring fingers 24 may be overcome by additional flexing of the spring fingers 24 above the collar 30. Accordingly, the spring fingers 24 operate in the normal manner when the collar 30 is in the unlocked position. FIG. 2B is a perspective view of a USB device 40 having its connector 10 inserted and coupled into the USB header 20.

Figure 2C:
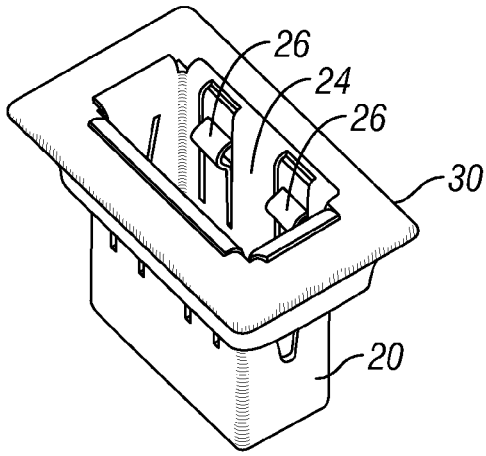
FIG. 2C is a perspective view of the USB header of FIG. 2A with the axially slidably collar in the locked position.
Figure 2B:
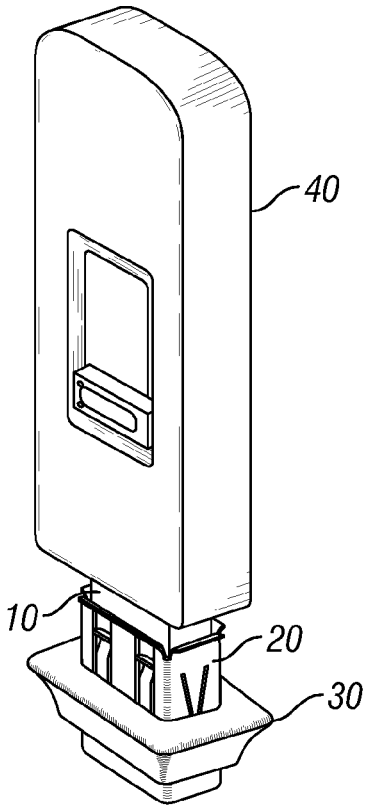
FIG. 2B is a perspective view of a USB device having its connector inserted into the USB header.

FIG. 2C is a perspective view of the USB header 20 of FIG. 2A with the axially slidably collar 30 in the locked position. In this position, the collar 30 blocks the spring fingers 24 from flexing outwardly and secures the tabs 26 in a position where the tabs would be engaged in the windows 14 of the device connector 10 (not shown in this figure).

Figure 2D:
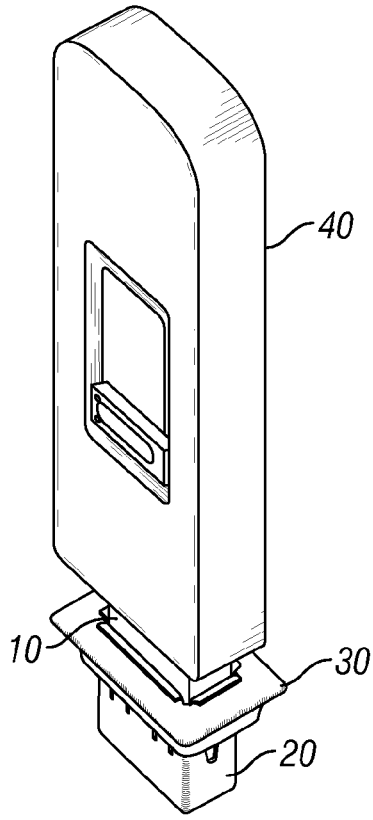
FIG. 2D is a perspective view of a USB device having its connector inserted into the USB header and locked to the USB header.

FIG. 2D is a perspective view of the USB device 40 having its connector 10 inserted into the USB header 20 and locked to the USB header. As long as the collar 30 remains in the locked position, the device connector 10 can not be removed. Preferably, the collar 30 fits tight enough about the rectangular header 20 so that the collar 30 will remain in the locked position unless intentionally acted upon by the user. However, other means for retaining the collar in the locked position can be easily implemented, such as using springs.

Figure 3A:
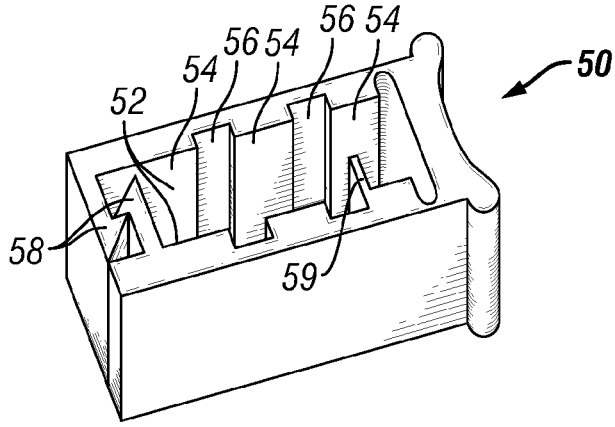
FIG. 3A is a perspective view of a transversely slidable collar for use with a USB header.

FIG. 3A is a perspective view of a transversely slidable collar 50 for use with a USB header. The collar 50 has opposing faces 52 that slide along the opposing sides of the rectangular header body 22 that have the spring fingers 24 (See FIG. 1A). Each face 52 has a groove 56 for each spring finger on that side of the header. The grooves 56 have adjacent lands 54 that are generally aligned within a plane for sliding against the header body 22. In accordance with an optional embodiment of the invention, the collar 50 includes a pair of hooks 58 at one end such that the collar 50 may be flexed opened to receive the USB header and then coupled around the USB header. Furthermore, the collar 50 has a spring member 59 that serves to engage the USB header and bias the collar 50 toward a locked position, as will be described in more detail with respect to FIGS. 3B and 3C.

Figure 3B:
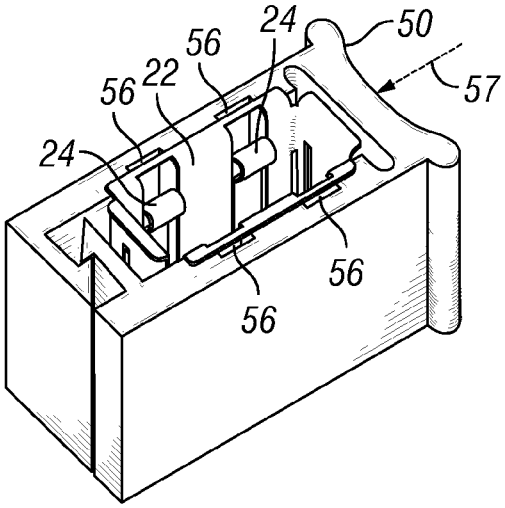
FIG. 3B is a perspective view of the transversely slidable collar of FIG. 3A received about a USB header and placed in an unlocked position.

FIG. 3B is a perspective view of the transversely slidable collar 50 of FIG. 3A received about a USB header body 22 and placed in an unlocked position. In the unlocked position shown, the collar 50 has slid transversely (as shown by arrow 57) so that the grooves 56 are transversely aligned with the spring fingers 24. Accordingly, the spring fingers 24 are free to flex outwardly and be received within the grooves 56 so that a USB device connector can be installed or removed from the header body 22. The spring member 59 has been folded back between the lands 54 and the USB header body 22 under the force shown by the arrow 57.

Figure 3C:
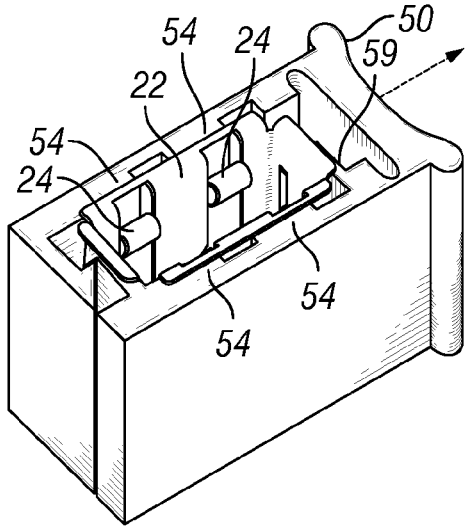
FIG. 3C is a perspective view of the transversely slidable collar of FIG. 3B placed in a locked position.

FIG. 3C is a perspective view of the transversely slidable collar 50 of FIG. 3B placed in a locked position. Preferably, the spring member 59 has biased the collar 50 into the locked position (as shown) upon the release of manual forces in the direction of arrow 57 (See FIG. 3B). In the locked position, the lands 54 are now transversely aligned with the spring fingers 24, such that the lands block the spring fingers from flexing outwardly. Accordingly, a USB device connector can neither be installed nor removed so long as the collar 50 remains in this position. Note that the spring member 59 has biased that collar 50 back into the locked position and rests against the end of the USB header body 22.

Figure 4A:
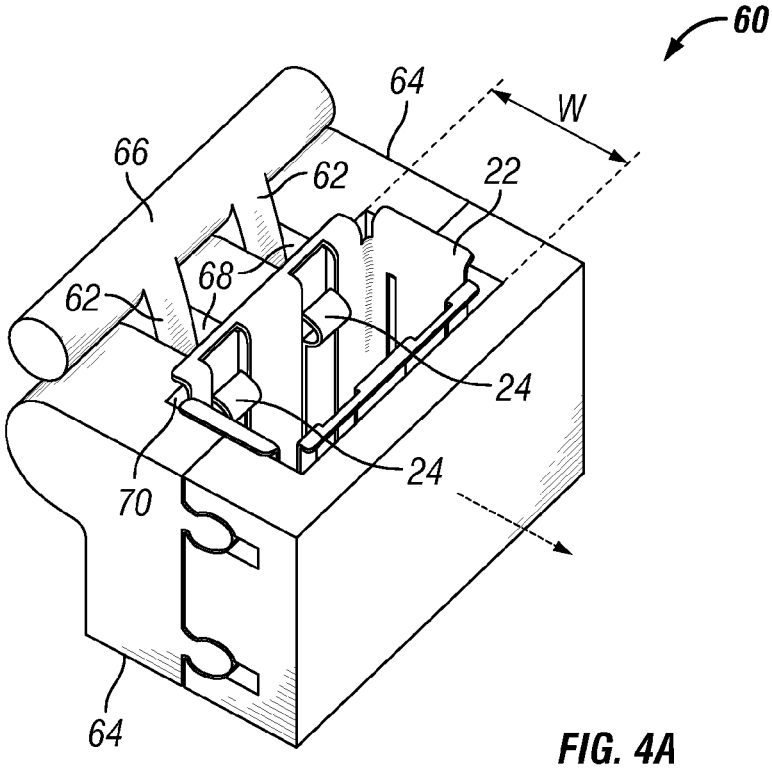
FIG. 4A is a perspective view of a collar secured about a USB header and pivotally coupling a lever that is shown in the unlocked position.

FIG. 4A is a perspective view of a collar 60 secured about a USB header body 22 and pivotally coupling levers 62 that are shown in the unlocked position. Although various collar designs are possible, the collar 60 is formed by two halves 62 that are snapped together about the header body 22 along two interfaces 64. The levers 62 are operated with a common handle 66 that is accessible for actuation by a user's finger. The levers 62 pivot about a transverse axis B-B. With the handle 66 raised as shown, the levers 62 extend downward and away from the spring fingers 24 with which they are aligned. Accordingly, the levers 62 open up grooves 68 such that the spring fingers are free to flex outwardly. Furthermore, the width W of the inside opening in the collar 60 is sufficient to allow the spring fingers 24 on the side opposite of the levers 62 to flex outwardly and push the collar 60 away. The collar must be pushed far enough (to the right in FIG. 4A) to allow the spring fingers 24 sufficient room to flex outwardly for receiving or removing a device connector. The width W of the collar opening must facilitate this amount of displacement before the collar hits the header body 22 along the opposing edge 70.

Figure 4B:
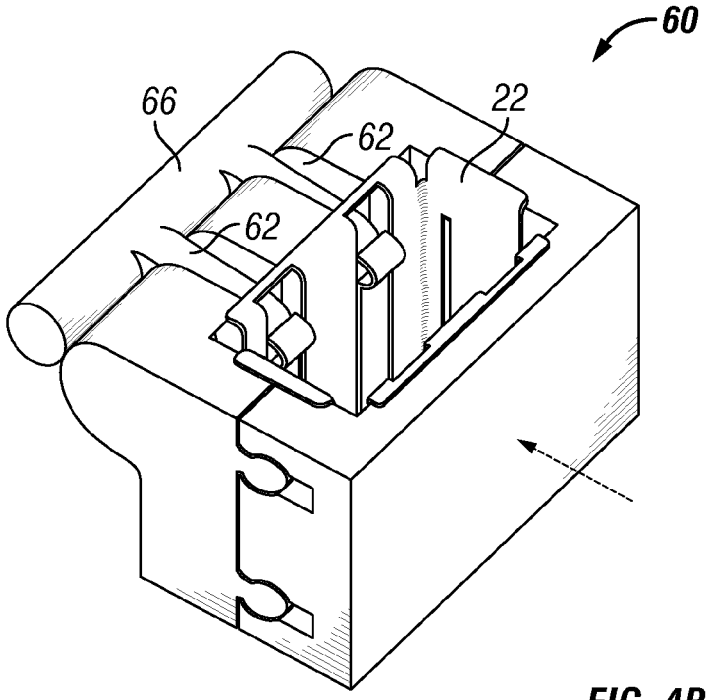
FIG. 4B is a perspective view of the collar of FIG. 4A with the lever in the locked position.

FIG. 4B is a perspective view of the collar 60 of FIG. 4A with the lever 62 in the locked position. With the handle 66 pushed downward, the ends of the levers 62 are raised and engage the spring fingers 24 that are adjacent grooves 68. Since the spring fingers 24 cannot flex inward (due to the presence of a device connector 10, not shown), continued depression of the handle 66 causes the levers to pull the collar 60 toward the levers 62 (leftward in FIG. 4B). Ultimately, the levers 62 engage the spring fingers 24 on one side and the body of the collar 60 engages the spring fingers 24 on the opposing side. Accordingly, the device remains in the locked position until intentionally acted upon by the user lifting the handle 66. The levers 62 may be held in the locked position in various ways, such as friction or by designing the levers to travel slightly beyond center (relative to pushback force of the spring fingers against the levers) before the lever handle 66 is stopped by the collar body.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A device for locking a Universal Serial Bus ("USB") device to a USB header, comprising:

a member secured to the USB header and slidable in a direction transverse to an insertion direction of the USB header, between a locked position that blocks outward movement of a spring finger of the USB header and an unlocked position that permits outward movement of the spring finger; and a spring integrally formed with and projecting from the member and in engagement with the USB header to bias the member to the locked position.

2. The device of claim 1, wherein the locked position causes the member to block outward movement of the spring finger directly behind a retention tab of the spring finger.

3. The device of claim 1, wherein the member includes a collar secured around the USB header.

4. The device of claim 3, wherein the collar has an inner surface with a land and a groove facing the spring finger, wherein the collar is slideable between the locked position with the land blocking movement of the spring finger and the unlocked position with the groove allowing movement of the spring finger.

5. The device of claim 3, wherein the collar may be opened at one end to be selectively received around the USB header below a flared end of the USB header.

6. A device, comprising:

a USB header having spring fingers configured to spring outward as a USB device connector is being inserted or withdrawn and to spring inward into windows formed in the USB device connector when the USB device connector is fully inserted or fully withdrawn; and a lever pivotally coupled to a collar secured to the USB header, the lever being selectively pivotable between a locked position that engages the spring fingers to block outward movement of the spring fingers and an unlocked position in which the lever is spaced from the spring finger to permit outward movement of the spring fingers.

7. The device of claim 6, wherein the collar is secured around the USB header.

* * * * *